United States Patent [19]

Winter

[11] 4,428,682

[45] Jan. 31, 1984

[54] CLOCK MECHANISM

[76] Inventor: Munroe A. Winter, 333 Crescent Dr., Lake Bluff, Ill. 60044

[21] Appl. No.: 428,419

[22] Filed: Sep. 29, 1982

[51] Int. Cl.[3] ..... G04B 19/04

[52] U.S. Cl. ..... 368/238; 368/223; 368/228; 368/221

[58] Field of Search ..... 368/185, 187, 60, 77, 368/40, 80, 51, 63, 28, 31, 34-36, 40, 223-226, 228, 232, 238, 221

[56] References Cited

U.S. PATENT DOCUMENTS

| | | | |
|---|---|---|---|
| 2,353,280 | 7/1944 | Swisher | 58/125 |
| 2,777,280 | 1/1957 | Petters | 58/80 |
| 3,668,858 | 6/1972 | Hartwig | 58/2 |
| 3,712,046 | 1/1973 | Dill | 58/23 R |
| 4,254,493 | 3/1981 | Billet | 368/185 |

*Primary Examiner*—Bernard Roskoski

*Attorney, Agent, or Firm*—Wood, Dalton, Phillips, Mason & Rowe

[57] ABSTRACT

A clock mechanism including a fixed ring defining an inner annular surface and an outer annular surface. An hours disc is disposed to roll against one of the surfaces so as to traverse the full annular extent thereof once every twelve hours. A minute disc is disposed to roll against the other of the annular surfaces so as to traverse the full annular extent thereof once every hour. In the illustrated embodiment, the discs define planet gears, with the hours planet gear being driven by an hours sun gear so as to roll against the inner ring gear of the fixed ring. The minutes disc defines a planet gear driven by an outer ring gear to roll against the outer minute sun gear defined by the outer annular surface of the fixed ring. The fixed ring may be provided with suitable indicia to define a chapter ring.

14 Claims, 5 Drawing Figures

CLOCK MECHANISM

BACKGROUND OF THE INVENTION

1. Field of the Invention

This invention relates to clock mechanisms and in particular to an analog clock mechanism wherein the hours and minutes are indicated by elements moving along the annular extent of a chapter ring.

2. Description of the Background Art

It is conventional in clock mechanisms to provide hands which sweep over the annular surface of a chapter ring which is suitably marked with hours and minutes designations so as to provide an analog designation of the time as a result of the hands being moved at preselected rates in their sweeping movement. One such clock is the astronomical clock disclosed by John L. Blair in U.S. Pat. No. 246,061 which further includes a disk, or sphere, representing the earth to which is imparted an independent rotation as it passes around the sun and about which representation of the earth is a stationary ring laid off with a double set of figures for the hours of night and day which, with the earth, gives the longitude and time while the moon is made to revolve around the earth with an independent revolution.

Another analog clock of this type is disclosed in U.S. Pat. No. 3,668,858 of Rudiger Hartwig, wherein the clock is provided with planetary gear wheels provided with inner teeth engaging stationary elements with outer teeth to obtain uniform rotation for successive gear stages. An eccentric drive of one stage necessary for engagement is directly effected by the eccentric shape of the rotating element of the preceding stage. The rotating elements belonging to each stage act as moving elements and an indicating elements due to their markings.

In U.S. Pat. No. 4,254,493, Alain Billet discloses a watch having epicyclic speed reduction gearing to drive the hour hand from the minute hand with a quick hour setting device to change the hour hand without affecting the timekeeping function being measured by the minute hand.

SUMMARY OF THE INVENTION

The present invention comprehends an improved clock mechanism wherein an hours disc is disposed to roll against one of the inner and outer annular surfaces of a chapter ring and a minutes disc is disposed to roll against the other of the chapter ring inner and outer annular surfaces, with means for causing the hour disc to traverse the full annular extent of the chapter ring once every twelve hours and the minute disc to transverse the full annular extent of the chapter ring once every hour.

In the illustrated embodiment, the mechanism comprises a pair of integrated eccentric gear trains in which an inner hours train includes an inner sun gear which rolls a planet gear around an outer fixed ring gear. The outer minutes train includes a planet gear which is rolled around an inner fixed sun gear by an outer ring gear.

In the illustrated embodiment, the hours sun gear and the minutes ring gear are fixed to a common rotating main gear wheel.

In the illustrated embodiment, the hours ring gear and the minutes sun gear are joined to a stationary wheel.

The stationary wheel, in the illustrated embodiment, carries a chapter ring.

The driving input to the clock is by rotation of the main gear wheel which, in turn, drives both the hours train and the minutes train.

The invention comprehends that the ratios of the sun gear to the minute gear in each of the trains are such that when the hours planet gear is rotated one cycle, the minutes planet gear is rotated 12 cycles.

In the illustrated embodiment, the rotation of the main gear wheel is preferably at a constant rate of approximately 12 to 24 revolutions per 12 hours.

In the illustrated embodiment, the number of revolutions of the main gear is preferably determined by the equation $$N = \frac{C}{A} + 1 = 12\left(\frac{D}{F} + 1\right)$$

where C is the number of teeth on the outer fixed ring gear, A is the hours train sun gear, D is the minutes train inner fixed sun gear, and F is the minutes train outer ring gear.

In a preferred embodiment, the value of N is 21, with C being 120, A being 6, D being 120, and F being 160, with the number of teeth on the hours train planet gear being 57 and the number of teeth on the minutes train planet gear being 20.

In broad aspect, the invention comprehends the use of planet gears as the hands of a clock.

In the illustrated embodiment, the planet gears define discs which roll against the inner and outer annular surfaces of the fixed ring respectively.

The clock mechanism of the present invention is extremely simple and economical of construction while yet providing a highly accurate and unique clock mechanism heretofore unknown in the art.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 1:
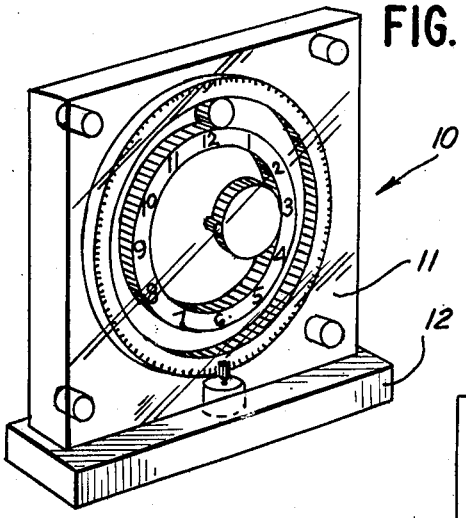
FIG. 1 is a perspective view of a clock mechanism embodying the invention.
Figure 4:
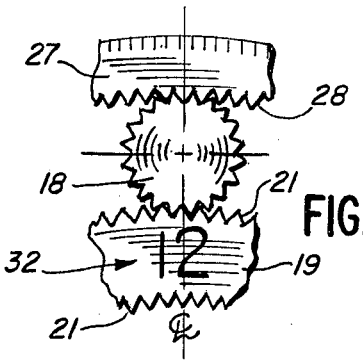
FIG. 4 is a fragmentary elevation illustrating the meshed relationship of the minutes planet gear, sun gear and ring gear.

In the illustrative embodiment of the invention as disclosed in the drawing, a clock mechanism generally designated 10 is shown to define a clock face structure generally designated 11 carried on a suitable base 12.

More specifically, the clock mechanism includes, in the illustrated embodiment, a back plate 13, a main wheel 14, a front plate 15, and a plurality of posts 16 for mounting the front plate in parallel spaced relationship with the back plate, with the main wheel interposed therebetween.

Figure 3:
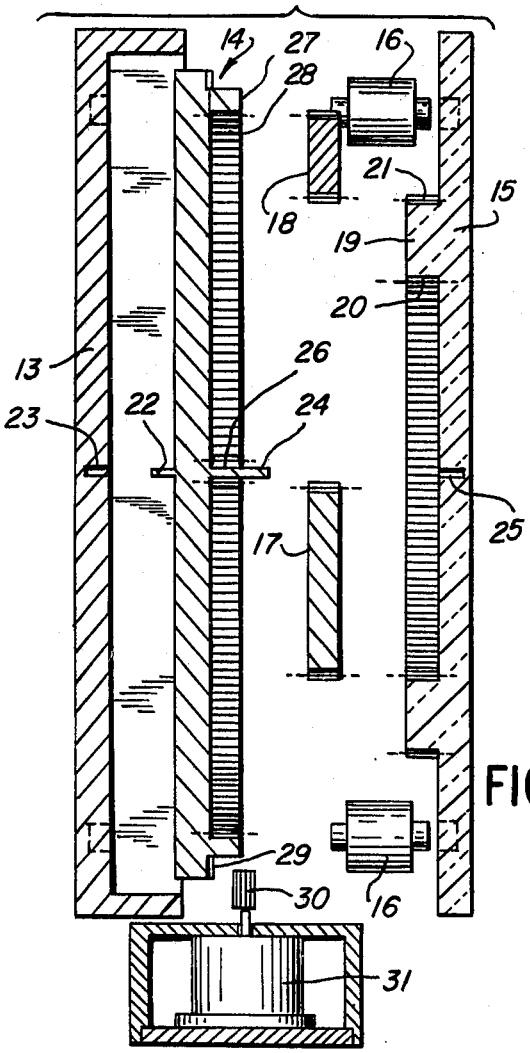
FIG. 3 is an exploded side view illustrating the relationship of the components of the clock mechanism in greater detail.
Figure 5:
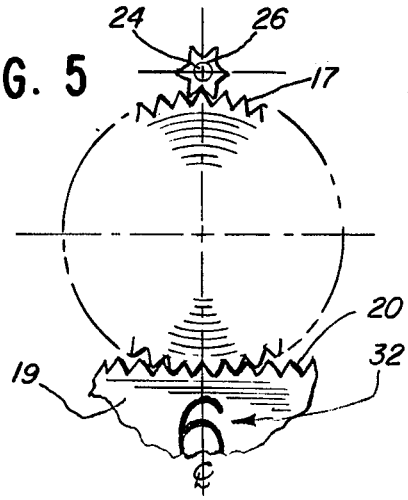
FIG. 5 is a fragmentary elevation illustrating the meshed relationship of the hours planet gear, sun gear, and ring gear.

As further illustrated in FIG. 3, the mechanism further includes an hours planet gear 17 and a minutes planet gear 18.

Front plate 15 defines a rearwardly projecting fixed ring 19 effectively defining a chapter ring. The fixed ring includes an annular inner surface 20 defining an hours ring gear. The fixed ring further includes an outer annular surface 21 defining a minutes sun gear.

The main wheel includes a rearwardly projecting axial axle 22 received in a pivot recess 23 in back plate 13, and a forwardly extending axle 24 received in a pivot recess 25 in the front plate 15. Concentrically surrounding the front axle 24 is an hours sun gear 26.

The main wheel 14 includes a peripheral ring 27 having an inner annular surface 28 defining a minutes ring gear. Ring 27 further defines an axially front surface 29 defining a driven gear engaged by a drive gear 30, in turn driven from a suitable drive motor 31, such as a 1 rpm constant speed clock motor.

Figure 2:
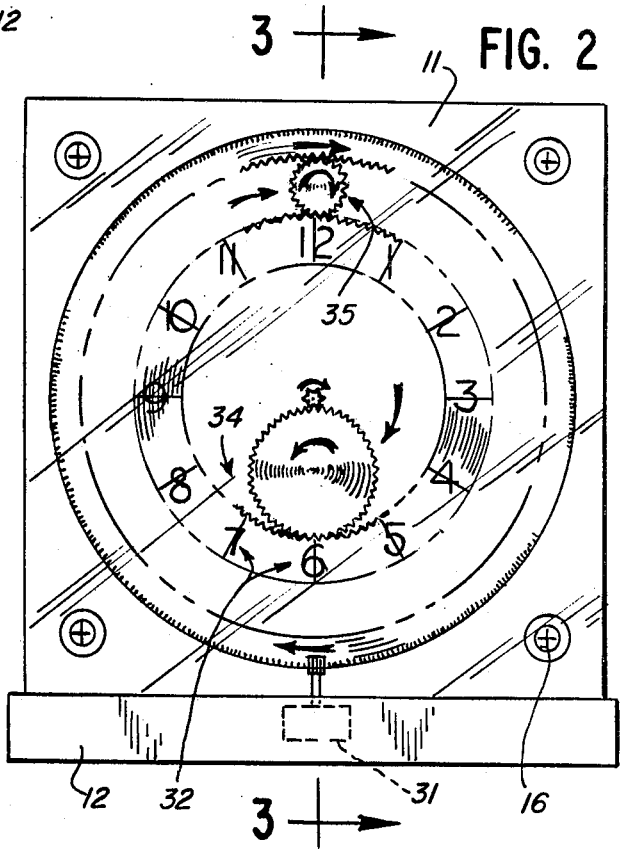
FIG. 2 is a fragmentary front elevation illustrating the clock mechanism in greater detail.

As seen in FIG. 2, fixed ring 19 may be provided with front readable indicia 32 for indicating the hours and minutes indicated by the clock mechanism. In the illustrated embodiment, fixed ring 19 is formed integrally with the front plate 15 which, in the illustrated embodiment, is transparent so as to permit viewing of the planet gears 17 and 18 therethrough. Determination of the position of the planet gears 17,18 relative to the indicia 32 of the chapter ring 19 provides an analog indication of the time.

More specifically, clock mechanism 10 effectively defines a pair of concentric gear trains generally designated 34 and 35. Inner gear train 34 comprises the hours gear train and includes the driven inner sun gear 26 which drives the planet gear 17 which, in turn, is meshed with the ring gear 20 so as to cause the planet gear to roll around the surface 20 once every 12 hours.

The outer gear train 35 includes the outer minutes ring gear 28 which drives the minutes planet gear 38 so as to cause the minutes planet gear to roll around the surface 21 once every hour. As indicated above, the gear surfaces 20 and 21 are fixed as a result of the fixed position of the ring 19 on front plate 15. In brief, the clock operates by rotation of the main wheel 14 which, in turn, drives the trains 34 and 35 from the sun gear 26 and ring gear 28 thereon.

The ratios of the teeth of the planet gears and meshing teeth of sun gear 26 and ring gear 28 are coordinated with the number of teeth on the inner and outer surfaces 20 and 21 of the fixed ring 19 so as to cause the desired rolling movement of the planet gears against the fixed ring gear surfaces 20 and 21 so as to provide the desired movement of the hours planet gear fully along the annular extent of gear 20 once every 12 hours and the minutes gear 18 fully along the annular extent of the fixed ring gear surface 21 once every hour.

In the preferred embodiment, the ratio of the gear teeth is expressed as:

$$N = \frac{C}{A} + 1 = 12\left(\frac{D}{F} + 1\right)$$

where A is the number of teeth of the sun gear 26, C is the number of teeth of the hour ring gear 20, D is the number of teeth of the minute sun gear 21, and F is the number of teeth of the outer ring gear 28. It is preferred that the value of N be in the range of approximately 19 to 23, and in the illustrated embodiment, the value of N is 21, permitting the use of a number of the gears with numbers of teeth as multiples of 12.

More specifically, in the illustrated embodiment, sun gear 18 is provided with 6 teeth, planet gear 17 is provided with 57 teeth, inner hours ring gear 20 is provided with 120 teeth, outer minutes sun gear 21 is provided with 120 teeth, planet gear 18 is provided with 20 teeth, and outer minutes ring gear 28 is provided with 160 teeth.

In the illustrated embodiment, gear 29 is provided with 240 teeth and drive gear 30 is provided with 7 teeth. Resultingly, clock mechanism 10 utilizing the above illustrated tooth arrangement of the preferred embodiment, provides an accurate analog clock mechanism which may be manufactured at low cost while yet providing a novel and improved analog readout of minute and hour time.

The specific arrangement of the components of the clock mechanism is exemplary, it being understood that other gear ratios and cooperating relationships may be provided within the scope of the invention. Illustratively, the invention comprehends the use of epicyclic drive systems and, thus, comprehends the provision of elements 17,18 as discs adapted to roll against the surfaces 20 and 21. All concepts of the clock portion 11 may be formed of transparent synthetic resin within the scope of the invention.

The foregoing disclosure of specific embodiments is illustrative of the broad inventive concepts comprehended by the invention.

I claim:

1. A clock mechanism comprising:

a fixed ring defining an inner annular surface and an outer annular surface;

an hours disc disposed to roll against one of said surfaces;

means for causing said hours disc to traverse the full annular extent of the engaged fixed ring, surface once every twelve hours;

a minutes disc disposed to roll against the other of said surfaces; and means for causing said minutes disc to transverse the full annular extent of said engaged other of said surfaces once every hour, whereby the disposition of said hours disc relative to said fixed ring may indicate hour time and the disposition of said minutes disc relative to said fixed ring may indicate minutes time.

2. The clock mechanism of claim 1 wherein said fixed ring comprises a chapter ring.

3. The clock mechanism of claim 1 wherein said fixed ring surfaces and said discs are provided with respectively complementary meshing teeth.

4. The clock mechanism of claim 1 including timed drive means for drivingly rotating said discs at different rotational rates against said fixed ring surfaces respectively.

5. The clock mechanism of claim 1 wherein said one surface comprises the radially inner surface of said fixed ring and said other surface comprises the radially outer surface of said fixed ring.

6. The clock mechanism of claim 1 wherein said one surface comprises the radially inner surface of said fixed ring and said other surface comprises the radially outer surface of said fixed ring, and further including timed drive means for drivingly rotating said discs at different rotational rates against said fixed ring surfaces respectively, said timed driving means comprising a wheel defining an outer ring gear driving said minutes disc and an inner sun gear driving said hours disc, said discs including peripheral gear teeth meshing respectively with said ring gear and sun gear.

7. The clock mechanism of claim 1 wherein said fixed ring is provided with time indicia.

8. The clock mechanism of claim 1 including timed drive means for drivingly rotating said discs at different rotational rates against said fixed ring surfaces respectively, said fixed ring being provided on a transport cover plate through which said hours and minutes discs are viewable.

9. The clock mechanism of claim 1 wherein said fixed ring surfaces and said discs are provided with respectively complementary meshing teeth, said fixed ring annular surfaces having the same number of teeth.

10. The clock mechanism of claim 1 wherein said fixed ring surfaces and said discs are provided with respectively complementary meshing teeth, said fixed ring annular surfaces each having 120 teeth.

11. The clock mechanism of claim 1 wherein said one surface comprises the radially inner surface of said fixed ring and said other surface comprises the radially outer surface of said fixed ring, and further including timed drive means for drivingly rotating said discs at different rotational rates against said fixed ring surfaces respectively, said timed driving means comprising a wheel defining an outer ring gear driving said minutes disc and an inner sun gear driving said hours discs, said discs including peripheral gear teeth meshing respectively with said ring gear and sun gear, the ratio of the number of teeth on said one surface to the number of teeth on the inner sun gear is in the range of approximately 18 to 22.

12. The clock mechanism of claim 1 wherein said one surface comprises the radially inner surface of said fixed ring and said other surface comprises the radially outer surface of said fixed ring, and further including timed drive means for drivingly rotating said discs at different rotational rates against said fixed ring surfaces respectively, said timed driving means comprising a wheel defining an outer ring gear driving said minutes disc and an inner sun gear driving said hours disc, said discs including peripheral gear teeth meshing respectively with said ring gear and sun gear, the ratio of the number of teeth on said one surface to the number of teeth on the inner sun gear is 20.

13. The clock mechanism of claim 1 wherein said one surface comprises the radially inner surface of said fixed ring and said other surface comprises the radially outer surface of said fixed ring, and further including timed drive means for drivingly rotating said discs at different rotational rates against said fixed ring surfaces respectively, said timed driving means comprising a wheel defining an outer ring gear driving said minutes disc and an inner sun gear driving said hours disc, said discs including peripheral gear teeth meshing respectively with said ring gear and sun gear, twelve times the sum of the ratio of the number of teeth on said other surface to the number of teeth on the outer ring gear plus one is in the range of approximately 19 to 23.

14. The clock mechanism of claim 1 wherein said one surface comprises the radially inner surface of said fixed ring and said other surface comprises the radially outer surface of said fixed ring, and further including timed drive means for drivingly rotating said discs at different rotational rates against said fixed ring surfaces respectively, said timed driving means comprising a wheel defining an outer ring gear driving said minutes disc and an inner sun gear driving said hours disc, said discs including peripheral gear teeth meshing respectively with said ring gear and sun gear, twelve times the sum of the ratio of the number of teeth on said other surface to the number of teeth on the outer ring gear plus one is 21.

* * * * *